US007759568B2

(12) United States Patent
Jackson

(10) Patent No.: US 7,759,568 B2
(45) **Date of Patent: *Jul. 20, 2010**

(54) PITCH ADJUSTMENT DEVICE FOR STRING INSTRUMENTS

(76) Inventor: David H Jackson, 137 Gooch Rd., Dahlonega, GA (US) 30533

( * ) Notice: Subject to any disclaimer, the term of this patent is extended or adjusted under 35 U.S.C. 154(b) by 924 days.

This patent is subject to a terminal disclaimer.

(21) Appl. No.: 11/489,073

(22) Filed: Jul. 19, 2006

(65) Prior Publication Data

US 2008/0017012 A1 Jan. 24, 2008

(51) Int. Cl.
*G10D 1/08* (2006.01)

(52) U.S. Cl. ..... 84/312 R

(58) Field of Classification Search ..... 84/312 R, 84/313, 423 R

See application file for complete search history.

(56) References Cited

U.S. PATENT DOCUMENTS

| | | | | |
|---|---|---|---|---|
| 2,973,682 | A | 3/1961 | Fender | |
| 3,390,600 | A | 7/1968 | Kelley, Jr. | |
| 3,688,631 | A | 9/1972 | Jackson | |
| 4,080,864 | A | 3/1978 | Jackson | |
| 4,080,865 | A * | 3/1978 | Gfell | 84/312 R |
| 4,858,509 | A | 8/1989 | Marshall | |
| 5,092,214 | A | 3/1992 | Flynn | |
| 7,465,860 | B2 * | 12/2008 | Jackson | 84/312 R |
| 2008/0229899 | A1 * | 9/2008 | Steinberger | 84/313 |

OTHER PUBLICATIONS

Office Action dated Aug. 28, 2007, for related U.S. Appl. No. 11/489,318, filed Jul. 19, 2006, Inventor: David H. Jackson (6 pages).

* cited by examiner

*Primary Examiner*—Kimberly R Lockett
(74) *Attorney, Agent, or Firm*—Vista IP Law Group LLP

(57) ABSTRACT

A pitch adjustment device for selectively adjusting the pitch of the string(s) of a stringed musical instrument. Each string of the instrument is attached to a respective pitch adjustment device. Each pitch adjustment device comprises a tuning key to which the string is attached. The tuning key is mounted on a pivotable lever. A pull rod is attached to the lever to selectively pivot the lever. When the pull rod is actuated, it causes the lever and the tuning key to pivot, thereby adjusting the tension or pitch of the string. While the lever and tuning key pivot, the adjustment of the tuning key relative to the lever remains unchanged. Accordingly, when the pull rod is deactuated, the lever and tuning key return to their original position and the string returns to its normal open pitch. A roller nut having a pivoting knife-edged surface is also provided.

20 Claims, 4 Drawing Sheets

PITCH ADJUSTMENT DEVICE FOR STRING INSTRUMENTS

FIELD OF THE INVENTION

The field of the invention generally relates to stringed musical instruments, and more particularly to a device for selectively adjusting the tension (and therefore pitch) of the strings of such musical instruments while the instrument is being played.

BACKGROUND OF THE INVENTION

In the past, various pitch adjusting mechanisms for stringed musical instruments have been provided. These pitch adjusting mechanisms generally operate by selectively increasing or decreasing the tension or pitch of a string by moving one of the secured ends of the string to either increase the tension (to raise the pitch) or decrease the tension (to lower the pitch).

These types of pitch adjusting mechanisms have found widespread application on steel guitars. In general, a steel guitar is a generally horizontally mounted guitar having a head end and a tail end and a plurality of strings extending therebetween. The head end is provided with a plurality of tuning keys (one for each string) to which one end of a string is secured. The tuning keys allow adjustment of the pitch of each string to tune the guitar. The other end of the string is secured to a bridge at the tail end of the guitar.

Typical examples of pitch adjusting mechanisms for string instruments, such as a steel guitar, are found in U.S. Pat. No. 3,688,631 and U.S. Pat. No. 3,390,600. These patents are expressly incorporated by reference herein in their entireties. Each of these patents discloses a pitch adjusting mechanism for adjusting the pitch of an individual string both upwardly or downwardly. The mechanisms in both of these two patents also have in common that the pitch adjusting mechanism is provided at the bridge end of the strings and the mechanisms comprise relatively complicated systems of levers, springs and linkages. In order to provide for both raising and lowering the pitch of the string with a single lever attached to the string, the mechanisms must provide for a system which allows the single lever to be selectively actuated in both directions, i.e. clockwise and counter-clockwise, and also provide a means for returning the string to the open tune position (this means the normal pitch of the string without actuation of the pitch adjusting mechanism) upon de-actuation. Accordingly, the springs and lever arms of each of the parts of these mechanisms must be delicately balanced to provide proper operation and to minimize or avoid mis-tuning.

Therefore, there is need for a pitch adjustment device for stringed instruments which overcomes the problems associated with prior devices.

SUMMARY OF THE INVENTION

The present invention comprises a pitch adjustment device for selectively adjusting the pitch of the string(s) of a stringed musical instrument. Simply stated, in one aspect of the invention, the pitch adjustment device comprises mounting a tuning key for a string on a pivotable lever. The tuning key comprises a tuning shaft to which the string is secured and around which the string is wound. As with a standard guitar, the open tuning of the string (i.e., with the lever in the "normal position") can be adjusted by adjusting the tuning key using an adjustment member, such as a knob, screw head or bolt head. Adjustment of the tuning key causes the tuning shaft to rotate to adjust the tension on the string, independent of the pivoting of the lever.

The selective adjustment of the tension, or pitch, of the string is attained by pivoting the lever. Specifically, pivoting of the lever causes the tuning key to pivot which changes the tension on the string, while at the same time, the rotational position of the tuning shaft relative to the lever remains unchanged. In this way, the open tuning of the string will be maintained when the lever is returned to the normal position.

In another aspect of the present invention, an innovative string support for stringed instruments is provided. The string support design takes advantage of the fact that a string produces a better, more resonant sound if there is less contact between the string and its supports (such as the bridge and the nut of a guitar) defining the scale of the string. The scale is simply the length of the string that resonates to produce the pitch of the string. On a guitar, the scale is defined by the length from the nut to the bridge. The string support also provides for adjustment to account for the movement of the string caused by the selective pitch adjustment device. Bear in mind that when the selective pitch adjustment device of the present invention is actuated, the string will move slightly in the axial direction of the string (in one direction for raising the pitch and in the opposite direction for lowering the pitch).

Thus, the string support of the present invention comprises a pivoting member which pivots in a plane which is substantially parallel to the axial direction. A knife-edge surface is provided on the pivoting member such that the knife-edge surface pivots along with the pivoting of the pivoting member. The knife-edge surface is configured such that the only contact of the string between the scale is with the knife-edge surface throughout the normal range of pivoting of the pivoting member. The knife-edge surface provides for the optimum string sound and resonance and the pivoting action allows the knife-edge to move along with the string movement when the pitch adjustment device is actuated.

Additional aspects and features of the pitch adjustment device and related mechanisms of the present invention will become apparent from the drawings and detailed description provided below.

DETAILED DESCRIPTION OF THE INVENTION

Figure 1:
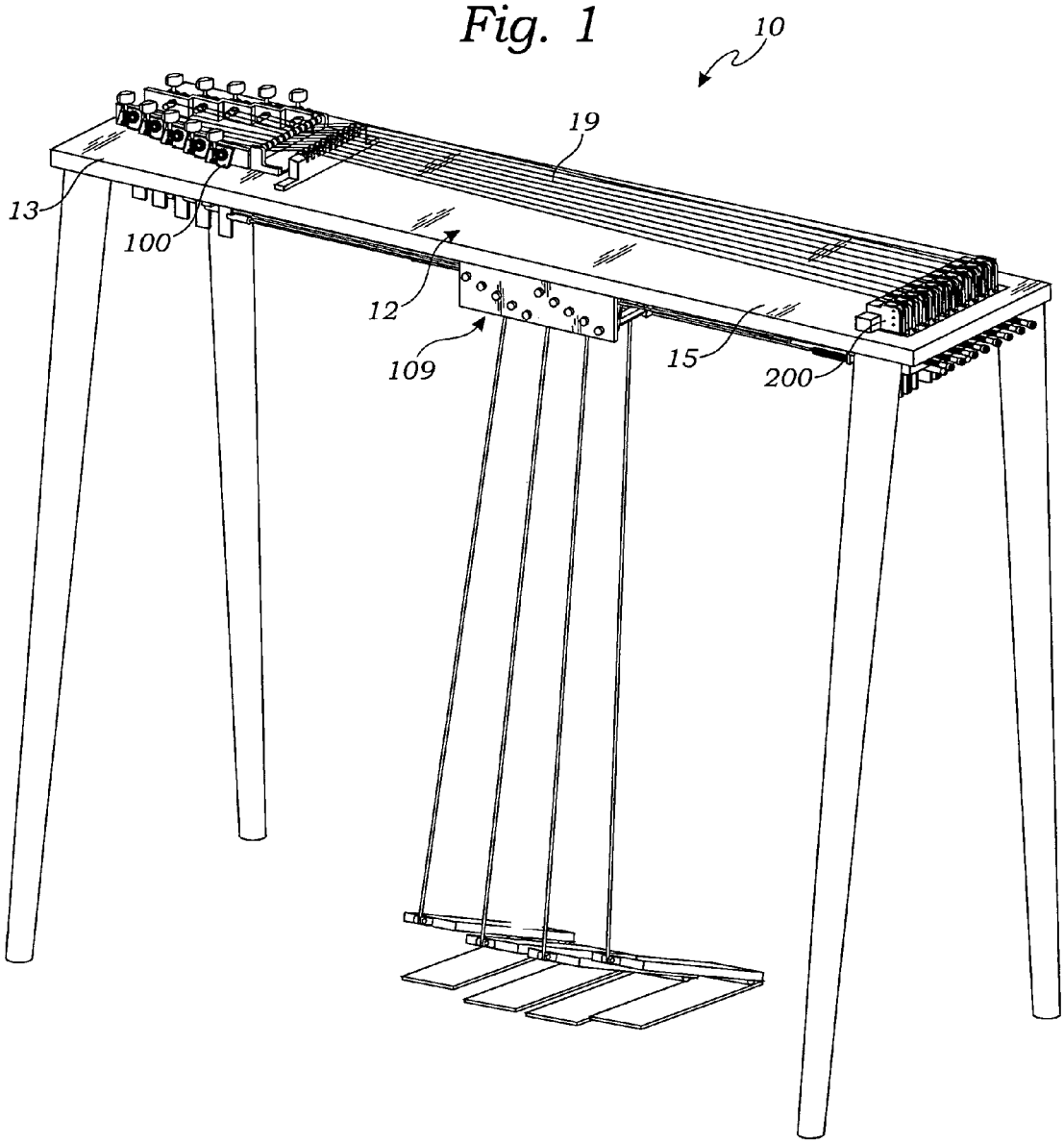
FIG. 1 is a side perspective view of an exemplary steel guitar having the pitch adjustment device of the present invention.

Referring to FIG. 1, the pitch adjustment device 100 of the present invention will be described in connection with an exemplary instrument, in this case a steel guitar 10. It should be understood that the pitch adjustment device 100 and other related features are not limited to a steel guitar 10 as shown and described, but can be applied to any stringed instrument. Therefore, the present invention is not limited to the embodiment on a steel guitar. Moreover, although the steel guitar 10 is shown with a single neck, it is common for steel guitars to have two necks, a front neck and a rear neck, as shown in U.S. Pat. No. 3,688,631. It should be understood that the present invention can easily be applied to both necks of a dual neck steel guitar.

The steel guitar 10 comprises a frame 12 having a head end 13 and a tail end 15. A plurality of strings (in this example, the guitar 10 has 10 strings) generally indicated at 19. The head end of each string 19 passes over a first string support 20 and then is operatively coupled to a first pitch adjustment device 100 which is attached to the head end 13 of the frame 12. The tail end of each string 19 is operatively coupled to a second pitch adjustment device 200 which is attached to the tail end 15 of the frame 12. There is a first pitch adjustment device 100 and a second pitch adjustment device 200 for each of the strings 19. All of the first pitch adjustment devices 100 and second pitch adjustment devices 200 are substantially identical for each string, and therefore it is sufficient to describe these assemblies for just one of the strings 19, although assemblies for two strings are shown in FIGS. 2-7. The assemblies for the other strings are substantially identical, except that the location of some components will vary in order to accommodate each of the assemblies for each of the strings. For example, as can be seen in FIG. 1, the location of each of the first pitch adjustment device 100 varies so that all 10 devices 100 can fit on the head end 13 of the guitar 10.

Referring now to FIGS. 2-7, the first pitch adjustment device 100 comprises a pivotable lever 102 pivotally coupled to a key frame 110 which is fixed to the head end 13 of the frame 12. The pivotable lever 102 pivots about an axis, which in the embodiment of FIG. 3, comprises a tuning shaft 114 of a tuning key 112. The axis of rotation of the pivotable lever 102 does not have to be the tuning shaft 114. For example, a separate pivot point spaced apart from the tuning shaft 114 can be provided using a rod or other suitable device for rotatably coupling the lever 102 to the head end 13 of the frame 12. In such case, the entire key frame 110 is not fixed to the frame 12 but is instead attached to the lever 10 such that the entire key frame 110 pivots along with the lever 102.

The tuning key 112 is attached to the upper end of the lever 102 and the lower end of the lever 102 passes through an aperture in the frame 12. A first end 106 of a pull rod 104 is operably coupled to the lower end of the lever 102. The second end 108 of the pull rod is operably coupled to an actuation apparatus 109 (see FIG. 1). The actuation apparatus may comprise a system of rocking assemblies and/or pedals such as those described in U.S. Pat. No. 3,688,631 for moving the pull rod 104 axially to the right (to pivot the lever 102 in the counter-clockwise direction) and to the left (to pivot the lever 102 in the clockwise direction). The actuation apparatus may bias the pull rod 104 in a first direction (either left or right) to the normal position (de-actuated or non-actuated position) and then move the pull rod 104 in the opposite direction to the actuated position. The normal position versus the actuated position of the pull rod 104 and the lever 102, and the direction of movement for actuation (right or left for the pull rod 104, counter-clockwise or clockwise for the lever 102), will be reversed depending on the desired result of actuation (i.e. raising the pitch or lowering the pitch of the string 19). In the configuration as shown in FIGS. 2-7, moving the pull rod 104 to the left rotates the lever 102 clockwise, thereby lowering the tension and pitch of the string 19. Moving the pull rod 104 to the right rotates the lever 102 counter-clockwise thereby raising the tension and pitch on the string 19.

A forward stop 20 is provided on the frame 12 which limits the movement of the lever 102 in the counter-clockwise direction. In the embodiment shown in the figures, the forward stop 20 is simply the right edge of the aperture in the frame 12 through which the lever 102 passes. The forward stop 20 may be fixed or it may be adjustable, such as by providing an adjustable screw or bolt which is placed to limit the movement of the lever 102 in the counter-clockwise direction. An adjustable second stop 22 is provided on the key frame 110 to limit the rotation of the lever 102 in the clockwise direction. The second stop 22 comprises a screw which can be adjusted to adjust the position of the second stop 22.

The tuning key 112 comprises the tuning shaft 114 and an adjustment member 116 operably coupled to the tuning shaft 114. The tuning key 112 is operably connected to the key frame 110 by rotatably coupling the tuning shaft 114 to the key frame 110 so that the tuning shaft 114 may rotate relatively freely relative to the key frame 110. This may be accomplished by simply inserting the tuning shaft 114 through an aperture in the key frame 110 and using a screw, rivet or other suitable fastener to retain the tuning shaft 114 in the aperture of the key frame 110. The tuning shaft 114 and aperture in the key frame 110 are properly sized to allow the tuning shaft 114 to rotate within the aperture. The head end of the string 19 is secured to the tuning shaft 114 of the tuning key 112 by inserting the end of the string 19 through a transverse hole in the tuning shaft 114, and then a portion of the string 19 is wound around the tuning shaft 114.

Figures 2, 2A, 3:
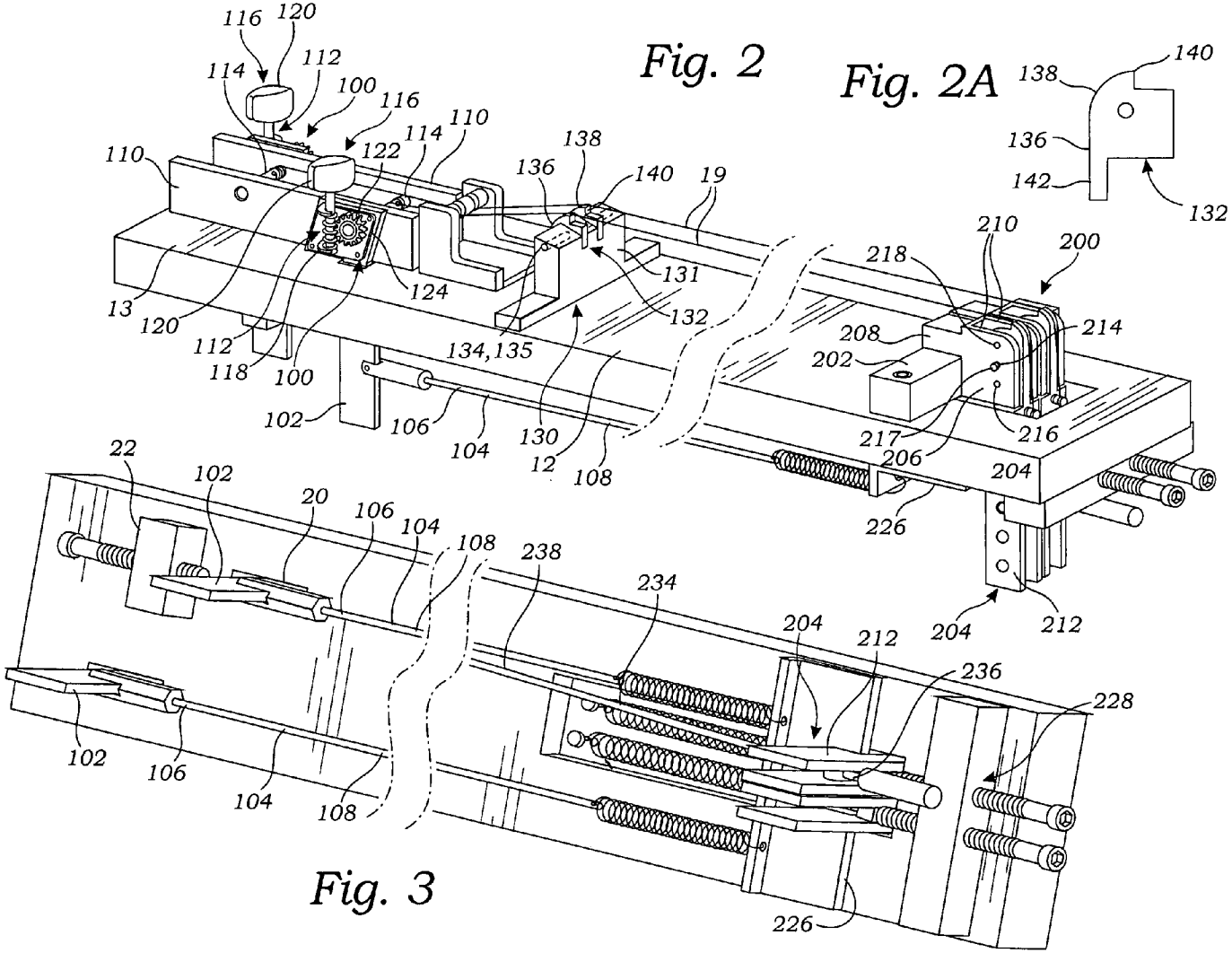
FIG. 2 is partial top perspective view of a pitch adjustment device according to the present invention, shown for two strings of the steel guitar of FIG. 1.
FIG. 2A is an enlarged, side view of the roller nut shown in FIG. 2.
FIG. 3 is partial bottom perspective view of a pitch adjustment device according to the present invention, shown for two strings of the steel guitar of FIG. 1.

As with a standard guitar, the tuning key 112 is used to tune the string 19 (for example, in the open tuned pitch) by rotating the tuning shaft 114 of the tuning key 112 to adjust the tension of the string 119 thereby adjusting the pitch. The adjustment member allows adjustment of the tuning key 112 by rotating the tuning shaft 114. The tuning adjustment accomplished using the adjustment member 116 is independent of the pitch adjustment provide by pivoting the pivotable lever 102, as described below. In other words, the adjustment member 116 rotates the tuning shaft 114 while the pivotable lever 102 remains stationary. The adjustment member 116 may be a structure provided on the tuning shaft 114, such as a knob for allowing manual adjustment, or a screw head or hex head for receiving a tuning tool such as a screw driver or wrench, or other suitable device. Or, as shown in FIG. 3, the adjustment device 116 may comprise a worm gear 118 having a knob 120. The worm gear 118 is rotatably coupled to a bracket 124. The worm gear 118 couples to a mating gear 122 provided on the tuning shaft 114. The bracket 124 is secured to the lever 102. In order to retain the proper tension and pitch on the string 19, the tuning key 112 should have a retaining device for preventing the tuning shaft 114 from unintentional rotation. If not retained in a tuned position, there can be unintended and unwanted rotation of tuning shaft 114 causing the string 19 to go out of proper tune. The retaining device may simply be a frictional fit between the tuning shaft and an aperture of a bracket through which is passes. In the embodiment of FIGS. 2-7, the worm gear 118 functions as both the adjustment device for the tuning shaft 114 and as a retaining device because a worm gear as configured will inherently resist rotation in response to the torque on the mating gear 122 created by the tension of the string 19.

The tuning key 112 is mounted on the pivotable lever 102 such that pivoting the lever 102 causes the tuning key 112 to pivot thereby adjusting the tension on the string 19 while the rotational position of the tuning shaft 114 relative to the lever 102 remains unchanged. Said another way, when the pivotable lever 102 is pivoted, the entire tuning key 112 pivots such that the string tension changes, but the tuning position of the tuning key 112 itself remains unchanged so that when the lever 102 is returned to the normal position, the pitch of the string returns to the open tune pitch.

Figure 4:
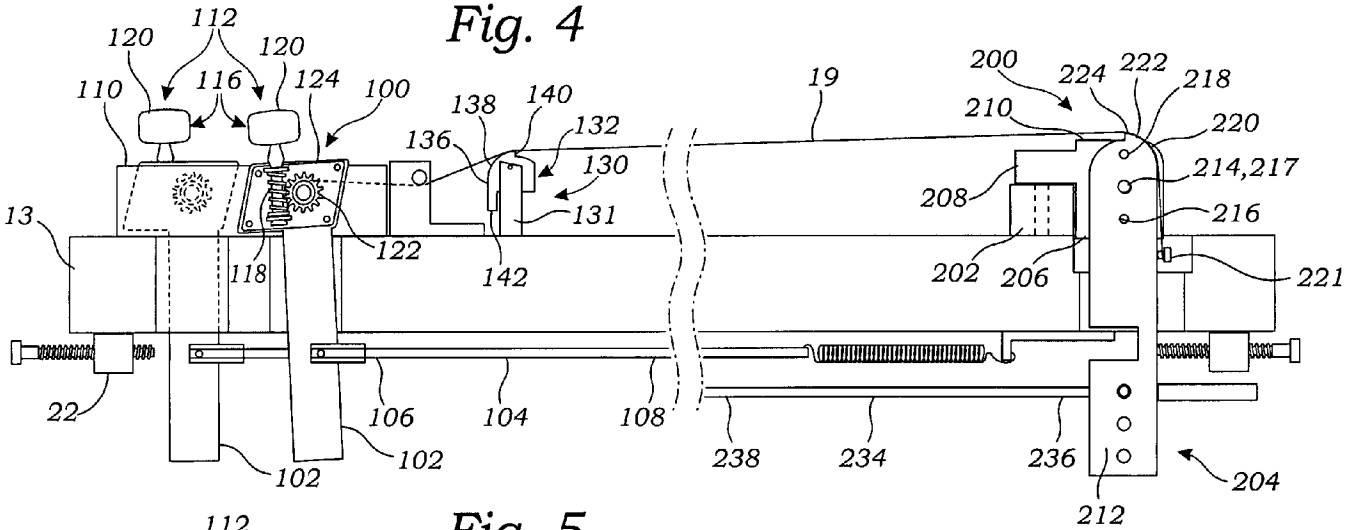
FIG. 4 is a partial side of a pitch adjustment device according to the present invention, shown for two strings of the steel guitar of FIG. 1.
Figure 5:
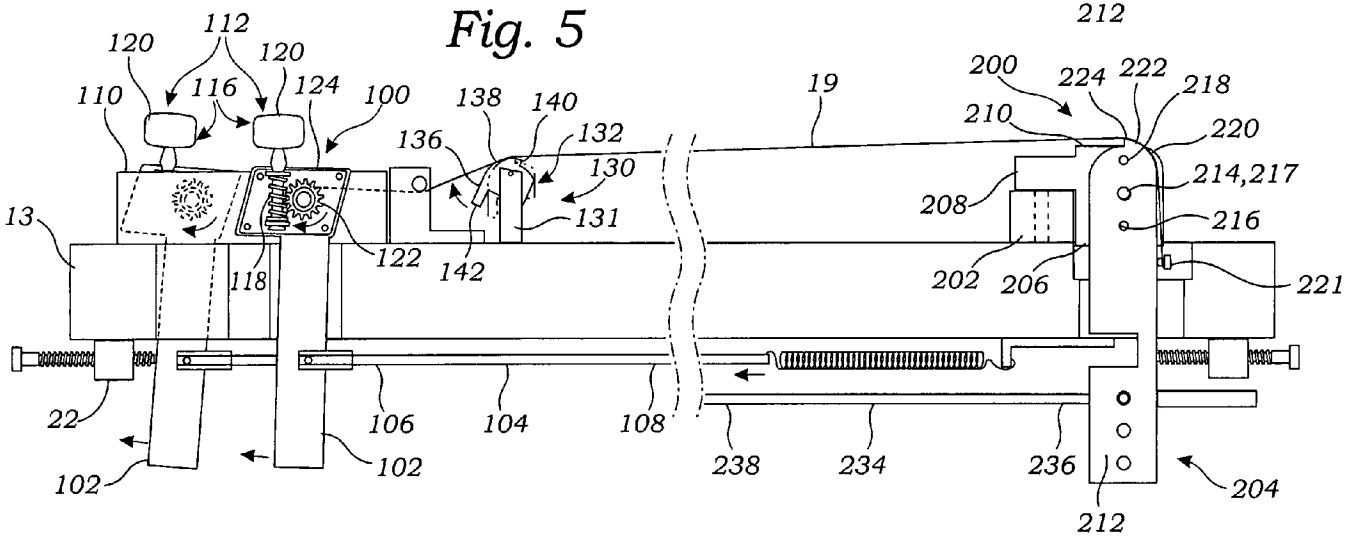
FIG. 5 is partial side perspective view of a pitch adjustment device according to the present invention, shown for two strings of the steel guitar of FIG. 1, with a first pitch adjustment device in the actuated position.

The operation of the pitch adjusting mechanism 100 is fairly straightforward. As discussed above, the pitch adjusting mechanism 100 can be configured for raising or for lowering the pitch of the string 19 from the normal position (i.e. open tune position of the string 19). Assuming that the position of the mechanism 100 as shown in FIG. 4 is the normal, or open pitch position, the mechanism 100 is configured to lower the string pitch upon actuation when moved to the position shown in FIG. 5. The actuation apparatus is configured to bias the lever 102 against the forward stop 20. The pitch adjusting mechanism 100 is then actuated by operating the actuation apparatus which moves the pull rod 104 to the left as shown in FIG. 5. The pull rod 104 pushes the lever 102, thereby pivoting the lever 102 and the tuning key 112 in a clockwise direction. The clockwise rotation of the tuning key 112 rotates the tuning shaft 114 in a clockwise direction thereby reducing the tension on the string and lowering the string pitch. However, the tuning key 112 and tuning shaft 114 do not rotate relative to the lever. The lever 102 stops when the limit of the second stop 22 is reached. Still, the tension and pitch of the string 19 is lowered by this movement. When the actuation apparatus is released (or reversed if not biased to the normal position), the pull rod 104 moves to the right and the lever 102 and tuning key 112 pivot in a counter-clockwise direction back to the position shown in FIG. 4, thereby raising the tension and pitch of the string 19. When the lever 102 returns to the normal position set by the forward stop 20, the string will have returned to the original open pitch because the rotational position of the tuning shaft 114 relative to the lever 102 was not changed by the pivoting of the lever 102 and tuning key 112.

In the configuration where the axis of the lever 102 is not coaxial to the axis of the tuning shaft 114, the operation of the pitch adjustment mechanism 100 is the same as described above, except that the movement of some of the components differs slightly. The pivoting of the lever 102 pivots the tuning key 112 such that the tuning shaft 114 revolves around the axis of the lever 102 rather than purely rotating as described above. Still, such motion of the tuning key 112 (and its tuning shaft 114) changes the tension and thus, the pitch of the string. Moreover, since the rotational position of the tuning key 112 and tuning shaft 114 relative to the lever 102 do not change upon the pivoting of the lever 102. Thus, upon return of the lever 102 to the normal position, the open pitch of the string 19 is maintained.

To configure the pitch adjusting mechanism 100 to raise the pitch of the string 19 when actuated from the normal position to the actuated position, simply reverse the normal position and actuated position, and reverse the direction of movement of the moving parts.

The pitch adjusting mechanism may further comprise a bridge nut 130 (string support) which defines the head end of the scale of the string 130, similar to the nut on a standard guitar. The bridge nut 130 of the present invention comprises a nut housing 131, a pivot 134 coupled to the housing 131 and a rolling nut 132 pivotally mounted on the pivot 134. The pivot 134 may comprise a rod 135 received in an aperture of the rolling nut 132 such that the rolling nut 132 may pivot about the rod. The rolling nut 132 preferably pivots in a plane which is substantially parallel to the axial direction of the string 19. The nut housing 131 and/or pivot 134 may receive all or several of the rolling nuts 132 for each string, or there may be a separate nut housing 131 and/or pivot 134 for each string 19.

As best shown in the enlarged view of FIG. 2A, the rolling nut 132 is a plate-like structure having circumferential surface 136. The circumferential surface has a curved portion 138 and a knife-edge surface 140 which is formed by a sharp ledge extending radially inward from the curved portion 138. The rolling nut 132 is oriented such that the end point of the contact of the rolling nut 132 with the string at the head end of the scale of the string is the knife-edge surface 140. The rolling nut 132 pivots about the pivot 134 to maintain the contact of the knife-edge surface 140 at the substantially the same point on the string 19 when the string 19 moves in response to actuation of the pitch adjusting mechanism 100. A return stop 142 is provided to limit the rotation of the rolling nut 132. The knife-edge surface 140 provides for the optimum string sound and resonance. The pivoting action prevents, or at least minimizes, unwanted squeaking of the string that can occur if the string 19 were to slide on the knife-edge surface 140 when the string moves in response to actuation of the pitch adjustment device 100.

Turning now to the tail end 15 of the guitar 10, the second pitch adjustment device 200 will be described. The second pitch adjustment device 200 comprises a bridge mount 202 which is attached to the tail end 15. A string puller 204 is attached to the bridge mount 202. The string puller 204 comprises a housing 206 having a mounting lug 208 and a pair of opposing plates 210 extending from the mounting lug 208. The opposing plates 210 have three sets of coaxial apertures 216, 217 and 218 vertically spaced apart. The upper end of a puller lever 212 is received between the plates 210 and is pivotally mounted on a pivot 214. The pivot 214 comprises a rod which is received in one of the sets of apertures 216, 217 or 218. In FIGS. 2-5, the pivot 214 is set in the aperture 218 and in FIG. 7 the pivot 214 is set in the aperture 216.

The upper end of the puller lever 212 comprises a circumferential surface 220, very similar to the circumferential surface 136 of the rolling nut 132 (see FIGS. 4-7). The circumferential surface 220 has a curved portion 222 and a knife-edge surface 224 which is formed by a sharp ledge extending radially inward from the curved portion 222. The knife-edge surface 224 is oriented such that the end point of the contact of the rolling nut circumferential surface 220 with the string 19 at the tail end of the scale of the string 19 is the knife-edge surface 224. In addition, through the normal pivoting of the puller lever 212, the end point of contact of the string 19 is the knife-edge surface 224. A string attachment 221 is also provided on the lever 212 for securing the tail end of the string 19 to the lever 212. The string attachment 221 can comprise a fitting have a grooved head for looping the string 19 around or any other suitable structure for securing the string 19. The string 19 extends from the string attachment 221, and over the circumferential surface 220 to the knife-edge surface 224.

Figure 6:
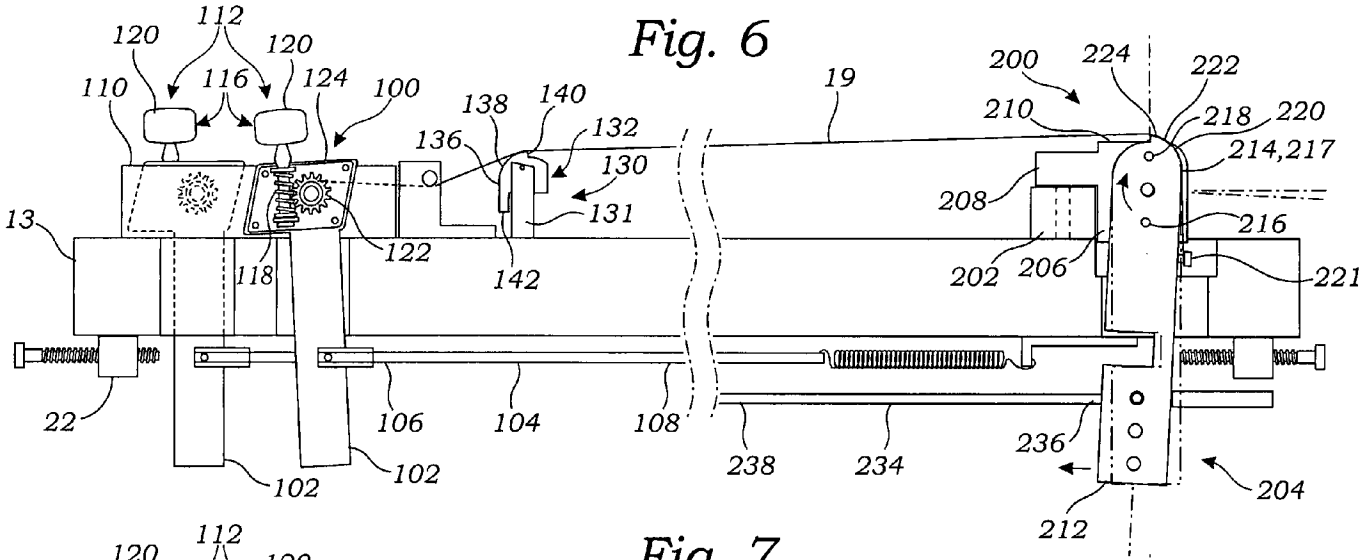
FIG. 6 is partial side perspective view of a pitch adjustment device according to the present invention, shown for two strings of the steel guitar of FIG. 1, with a second pitch adjustment device in an actuated position.
Figure 7:
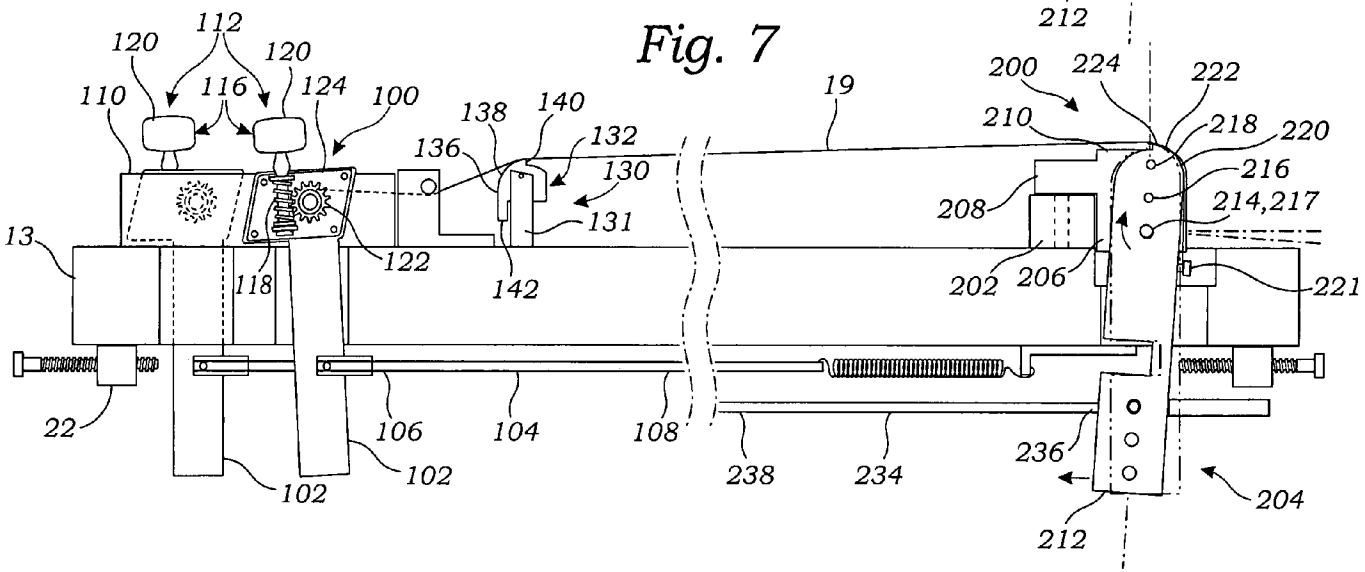
FIG. 7 is partial side perspective view of a pitch adjustment device according to the present invention, shown for two strings of the steel guitar of FIG. 1, with a second pitch adjustment device in an actuated position.

The three sets of apertures 216, 217 and 218, allows a choice for the radius of the lever arm between the pivot 214 and the tension of the string on the circumferential surface 220. For example, apertures 216 provide the smallest lever arm (for example ¼") which would be most appropriate for the string 19 having the least amount of tension. This is true because this string applies the least force which must be overcome to pivot the puller lever 212. The apertures 217 provide a medium lever arm (for example 5/16") which may be suitable for the middle strings. And the apertures 218 provide the largest lever arm (for example ⅜") which is most appropriate for the strings having the greatest tension. By utilizing differing radii for the pivoting of the upper end of the puller lever 212, the amount of force required to actuate the respective puller levers 212 for each string can be made more uniform. Thus, if the levers 212 are operably coupled to foot pedals, for example, the force required by the musician to push the pedals coupled to their respective strings can be to some extent matched. FIG. 6 shows the motion of puller lever 212 with the pivot 214 located in the middle aperture 217, while FIG. 7 shows the motion of the puller lever 212 with the pivot located in the lower aperture 217.

The lower end of the puller lever 212 extends through an aperture in the tail end 15 of the frame 12. A forward stop 226 is provided which limits the movement of the lever 212 in the clockwise direction and an adjustable second stop 228 is provided to limit the rotation of the lever 212 in the counter-clockwise direction. The second stop 228 comprises a screw which can be adjusted to adjust the position of the second stop 228.

A first end 236 of a pull rod 234 is operably coupled to the lower end of the lever 212. The lower end of the lever 212 may have a plurality of vertically spaced apart positions for coupling the pull rod 234 in order to provide varying lever arms for the same reasons described above. The second end 238 of the pull rod is operably coupled to an actuation apparatus (not shown). The actuation apparatus may comprise a system of rocking assemblies and/or pedals such as those described in U.S. Pat. No. 3,688,631 for moving the pull rod 234 axially to the right (to pivot the lever 102 in the counter-clockwise direction) and to the left (to pivot the lever 102 in the clockwise direction). The actuation apparatus may bias the pull rod 234 in a first direction (either left or right) to the normal position (de-actuated or non-actuated position) and then move the pull rod 234 in the opposite direction to the actuated position. The normal position versus the actuated position of the pull rod 104 and the lever 212, and the direction of movement for actuation (right or left for the pull rod 234, counter-clockwise or clockwise for the lever 212), will be reversed depending on the desired result of actuation (i.e. raising the pitch or lowering the pitch of the string 19). In the configuration as shown in FIG. 3, moving the pull rod 234 to the left rotates the lever 212 clockwise, thereby raising the tension and pitch of the string 19. Moving the pull rod 234 to the right rotates the lever 212 counter-clockwise thereby lowering the tension and pitch on the string 19.

The operation of the second pitch adjusting mechanism 200 is similar to the operation of the first pitch adjusting mechanism 100. As with the first pitch adjusting mechanism, the second pitch adjusting mechanism 200 can be configured for raising or for lowering the pitch of the string 19 from the normal position (i.e. open tune position of the string 19). Assuming that the position of the mechanism 200 as shown in the solid lines of FIGS. 6-7 is the normal, or open pitch position, the mechanism 200 is configured to raise the string pitch upon actuation. The actuation apparatus would typically be configured to bias the lever 212 against the second stop 228. The pitch adjusting mechanism 200 is then actuated by operating the actuation apparatus (not shown) which moves the pull rod 234 to the left. The pull rod 234 pulls the lever 212, thereby pivoting the lever 212 in a clockwise direction (as shown by the arrows in FIG. 6-7) to the position shown by the phantom lines in FIGS. 6-7. The clockwise rotation of the lever 212 increases the tension on the string 19 and raises the string pitch. The lever 212 is stopped when the limit of the forward stop 226 is reached. When the actuation apparatus is released (or reversed if not biased to the normal position), the pull rod 234 moves to the right and the lever 212 pivots in a counter-clockwise direction thereby lowering the tension and pitch of the string 19. When the lever 212 returns to the normal position set by the second stop 228, the string 19 will have returned to the original open pitch.

To configure the second pitch adjusting mechanism 200 to lower the pitch of the string 19 when actuated from the normal position to the actuated position, simply reverse the normal position and actuated position, and reverse the direction of movement of the moving parts.

As shown in FIGS. 2-7, and described above, each string has a first pitch adjusting mechanism 100 at its head end and a second pitch adjusting mechanism 200 at its tail end. It is preferably to configure the first and second pitch adjusting mechanism 100 and 200, such that one of the mechanisms raises the string pitch upon actuation and the other mechanism lowers the pitch upon actuation.

While embodiments of the present invention have been shown and described, various modifications may be made without departing from the scope of the present invention. The invention, therefore, should not be limited, except to the following claims, and their equivalents.

What is claimed is:

1. A device for selectively adjusting the tension of a string of a stringed musical instrument comprising:

a pivotable lever which pivots about a first axis; and a tuning key comprising a rotatable tuning shaft which is attachable to the string, and an adjustment member coupled to said tuning shaft which can be adjusted to produce rotation of said tuning shaft independent of the pivoting of said lever thereby adjusting the tension on the string, said tuning key mounted on said lever such that pivoting of said lever causes said tuning key to pivot thereby adjusting the tension on the string while the rotational position of the tuning shaft relative to said lever remains unchanged.

2. The device of claim 1 wherein said first axis is collinear to the axis of rotation of said tuning shaft such that pivoting of said tuning key causes rotation of said tuning shaft about its axis.

3. The device of claim 1 wherein said first axis is not collinear to the axis of rotation of said tuning shaft such that pivoting of said lever and said tuning key causes said tuning shaft to revolve around said first axis.

4. The device of claim 1, further comprising an adjustable stop which limits the rotation of said lever in a first direction of rotation.

5. The device of claim 4 wherein said adjustable stop comprises a screw threadingly engaged in a support such that adjusting said screw adjusts the position at which said adjustable stop limits the rotation of said lever.

6. The device of claim 1, wherein said adjustment member is coupled to said tuning shaft using a worm gear.

7. The device of claim 4 further comprises a second stop which limits the rotation of said lever in a second direction of rotation which is the opposite direction of said first direction of rotation.

8. A stringed musical instrument comprising:

a head end and a tail end;

a plurality of strings extending from said head end to said tail end, the head end of each string being attached to a pitch adjusting device comprising:

a tuning key comprising a rotatable tuning shaft around which the string is wound and an adjustment member coupled to said tuning shaft which can be rotated to produce rotation of said tuning shaft thereby adjusting the tension on the string; and a pivotable lever which pivots about said tuning shaft, said pivotable lever pivotally coupled to said head end of said instrument, said tuning key mounted on said lever such that pivoting of said lever causes said tuning key to pivot thereby producing rotation of said tuning shaft when said lever is pivoted.

9. The stringed musical instrument of claim 8, wherein each said pitch adjusting device further comprises an adjustable stop which limits the rotation of said lever in a first direction of rotation.

10. The stringed musical instrument of claim 9, wherein said adjustable stop comprises a screw threadingly engaged in a support such that adjusting said screw adjusts the position at which said adjustable stop limits the rotation of said lever.

11. The stringed musical instrument of claim 8, wherein said adjustment member coupled to said tuning shaft using a worm gear.

12. The stringed musical instrument of claim 9, further comprising a second stop which limits the rotation of said lever in a second direction of rotation which is the opposite direction of said first direction of rotation.

13. The stringed musical instrument of claim 8, wherein each pitch adjusting device further comprises a pull rod coupled to said lever such that axial motion of said pull rod causes said lever to pivot thereby rotating said tuning shaft.

14. The stringed musical instrument of claim 13, wherein each pitch adjusting device further comprises a rocking assembly operatively coupled to said pull rod and a pedal operatively coupled to said rocking assembly such that actuation of said pedal actuates said pitch adjusting device by rotating said tuning shaft.

15. The device of claim 1, further comprising a pivoting string support located adjacent said pivotable lever, said string support comprising a knife-edge surface upon which the string rides, said knife-edge surface disposed on a pivoting member such that said knife-edge surface may move substantially simultaneously with the movement of the string upon actuation of said pivotable lever.

16. A string support for supporting a string of a stringed instrument, the string extending in an axial direction, the string support comprising:

a pivoting member which pivots in a plane which is substantially parallel to the axial direction; and a knife-edge surface provided on said pivoting member wherein said knife-edge pivots along with the pivoting of said pivoting member such that contact of the string at a first end of the scale ends at said knife-edge surface throughout a normal range of pivoting of said pivoting member.

17. The string support of claim 16, wherein said knife-edge surface has a string contact length of less than 500 micrometers.

18. The string support of claim 16, wherein said knife-edge has a string contact length of less than 250 micrometers.

19. The string support of claim 16, wherein said pivoting member comprises a plate having an axis of rotation about which said plate may rotate, said plate having an outer circumferential surface which comprises a curved portion and said knife-edge surface formed by a sharp ledge extending radially inward from said curved portion.

20. The string support of claim 19, wherein said axis of rotation of said plate is eccentrically placed relative to the curved portion of said outer circumferential surface.

* * * * *